US011808075B2

(12) United States Patent
Young

(10) Patent No.: US 11,808,075 B2
(45) Date of Patent: Nov. 7, 2023

(54) COMBINATION SWITCH AND SLIDING BOLT LOCK WALL SAFE IMITATING A CIRCUIT BREAKER PANEL

(71) Applicant: Daniel L. Young, San Anselmo, CA (US)

(72) Inventor: Daniel L. Young, San Anselmo, CA (US)

( * ) Notice: Subject to any disclaimer, the term of this patent is extended or adjusted under 35 U.S.C. 154(b) by 171 days.

(21) Appl. No.: 17/386,294

(22) Filed: Jul. 27, 2021

(65) Prior Publication Data

US 2022/0034147 A1 Feb. 3, 2022

Related U.S. Application Data

(60) Provisional application No. 63/057,865, filed on Jul. 28, 2020.

(51) Int. Cl.

| | |
|---|---|
| ***E05G 1/04*** | (2006.01) |
| ***E05B 9/02*** | (2006.01) |
| ***E05G 1/026*** | (2006.01) |

(52) U.S. Cl.

CPC ..... *E05G 1/04* (2013.01); *E05B 9/02* (2013.01); *E05G 1/026* (2013.01)

(58) Field of Classification Search

CPC ..... E05B 9/00; E05B 9/02; E05B 9/04; E05G 1/04; E05G 1/026

USPC ..... 70/108

See application file for complete search history.

(56) References Cited

U.S. PATENT DOCUMENTS

| | | | | |
|---|---|---|---|---|
| 9,951,546 | B1 * | 4/2018 | Maniaci | E05B 17/2038 |
| 2016/0060906 | A1 * | 3/2016 | Stein | E05B 65/0082 292/341.15 |
| 2016/0060918 | A1 * | 3/2016 | Garrett | E05G 1/04 292/138 |

* cited by examiner

*Primary Examiner* — Nathan Cumar

(74) *Attorney, Agent, or Firm* — Brian Beverly; Beeson Skinner Beverly, LLP

(57) ABSTRACT

A combination faux switch and sliding bolt lock includes one or more imitation switches mounted on a cover to an enclosure, the cover and switches resembling a circuit breaker panel, each switch lock having a toggle arm including a back portion disposed in the enclosure behind the cover, manipulation of the toggle arm moving the back portion between first and second positions, the back portion slidably attached to a bolt one end of which is received in an aperture in the side walls of the enclosure locking the cover to the enclosure. One embodiment of the invention includes a plurality of combination faux switches and sliding bolts such that a locking combination may consist of any combination of the switches appearing to be in "off" or "on" positions.

12 Claims, 11 Drawing Sheets

COMBINATION SWITCH AND SLIDING BOLT LOCK WALL SAFE IMITATING A CIRCUIT BREAKER PANEL

CROSS-REFERENCE TO RELATED APPLICATIONS

This application claims the benefit of U.S. Provisional Application No. 63/057,865, filed Jul. 28, 2020, which is hereby incorporated fully by reference.

BACKGROUND

Field of the Invention

This invention relates to locks and safes and, more particularly, relates to a wall safe incorporating a combination faux switch and sliding bolt lock.

Description of Related Art

Efforts to conceal safes or other hidden compartments commonly involve hiding the enclosure behind a picture hanging on the wall, behind a sliding door, embedding a floor safe in a concrete foundation, behind an imitation vent, or disguising the enclosure in or as a furniture cabinet or even as a book. However, no attempts in the prior art have been made to hide a safe or storage compartment "in plain sight" by capitalizing on the dual advantages that circuit breaker panels are commonly exposed to view and therefore easily looked past and have built-in deterrents to a potential thief in that circuit breaker panels can be potentially dangerous and turning off electrical circuits could trigger an unwanted alarm.

SUMMARY OF THE INVENTION

The present invention provides a combination switch and sliding bolt lock for locking a door to or cover of a safe, chest, cabinet or other storage receptacle.

The lock includes a faux switch on the front face of the cover and a sliding bolt concealed behind the cover. The switch and bolt are connected so that a flip of the switch results in a sliding movement of the bolt. In some embodiments, the switch side is designed to look like a circuit breaker.

The lock is mounted in an opening in a cover to an enclosure. The switch extends through the aperture such that a front portion of it is accessible on the front side of the door, but a back portion that is connected to the bolt is hidden behind the cover. In a locked configuration, the cover is closed, and the switch is flipped to a position which causes the bolt to slide into an aperture in one of the side walls of the enclosure thereby preventing the cover from being removed from the sidewalls and locking the safe.

In one embodiment of the invention a plurality of faux switch and slide bolt locks are provided in a panel that resembles a circuit breaker panel. In a locked configuration each of one or more bolts are received in an aperture in each of two opposing side walls of the enclosure thereby locking the cover in place A combination switch and sliding bolt lock according to the invention can be used, for example, to lock the door or cover of a hidden enclosure such as a safe having a front cover disguised as a circuit breaker panel. If all the faux switches appear identical, the particular combination of switches and the positions of the switches as nominally being "on" or "off" must be known to unlock the cover and gain access to the enclosure.

BRIEF DESCRIPTION OF THE DRAWINGS

Exemplary embodiments of the invention will now be described with reference to the accompanying drawings, in which:

FIGS. 4A and 4B show the locks two different locked configurations. FIG. 4C shows the locks in an unlocked configuration.

DETAILED DESCRIPTION OF THE ILLUSTRATED EMBODIMENTS

Figure 1:
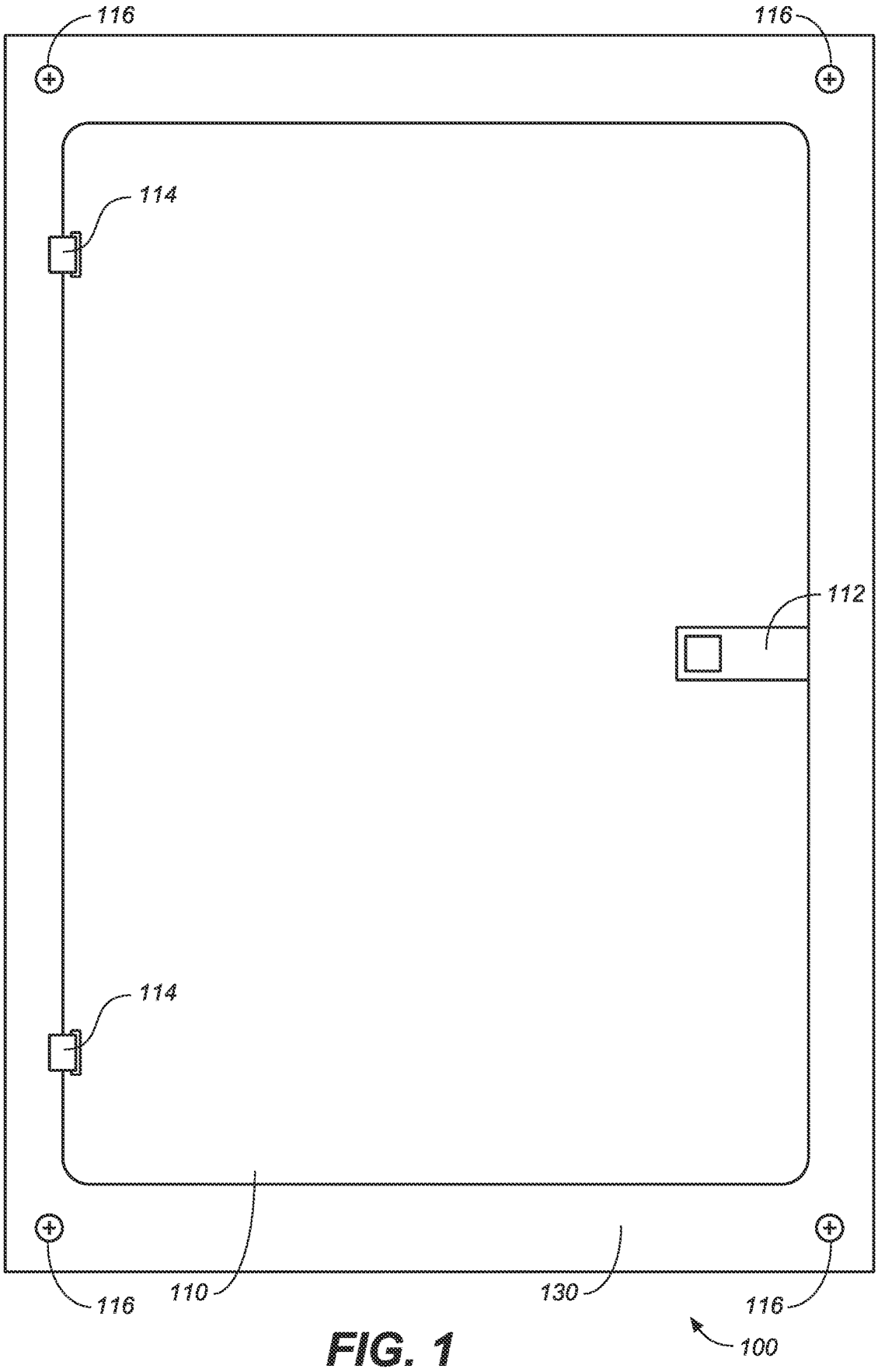
FIG. 1 shows a wall safe disguised as a circuit breaker panel according to the invention.

Referring to the drawings, FIG. 1 shows the front cover 130 of a wall safe 100 disguised as a circuit breaker panel. In the illustrated embodiment, the wall safe 100 is mounted in the stud bay of a wall by affixing the cover 130 of the safe 100 to the wall with screws 116. The door 110 is connected to the front cover 130 by a pair of hinges 114 and, in a closed configuration, is secured against the front cover 130 with a latch and spring clip assembly 112.

Figure 2:
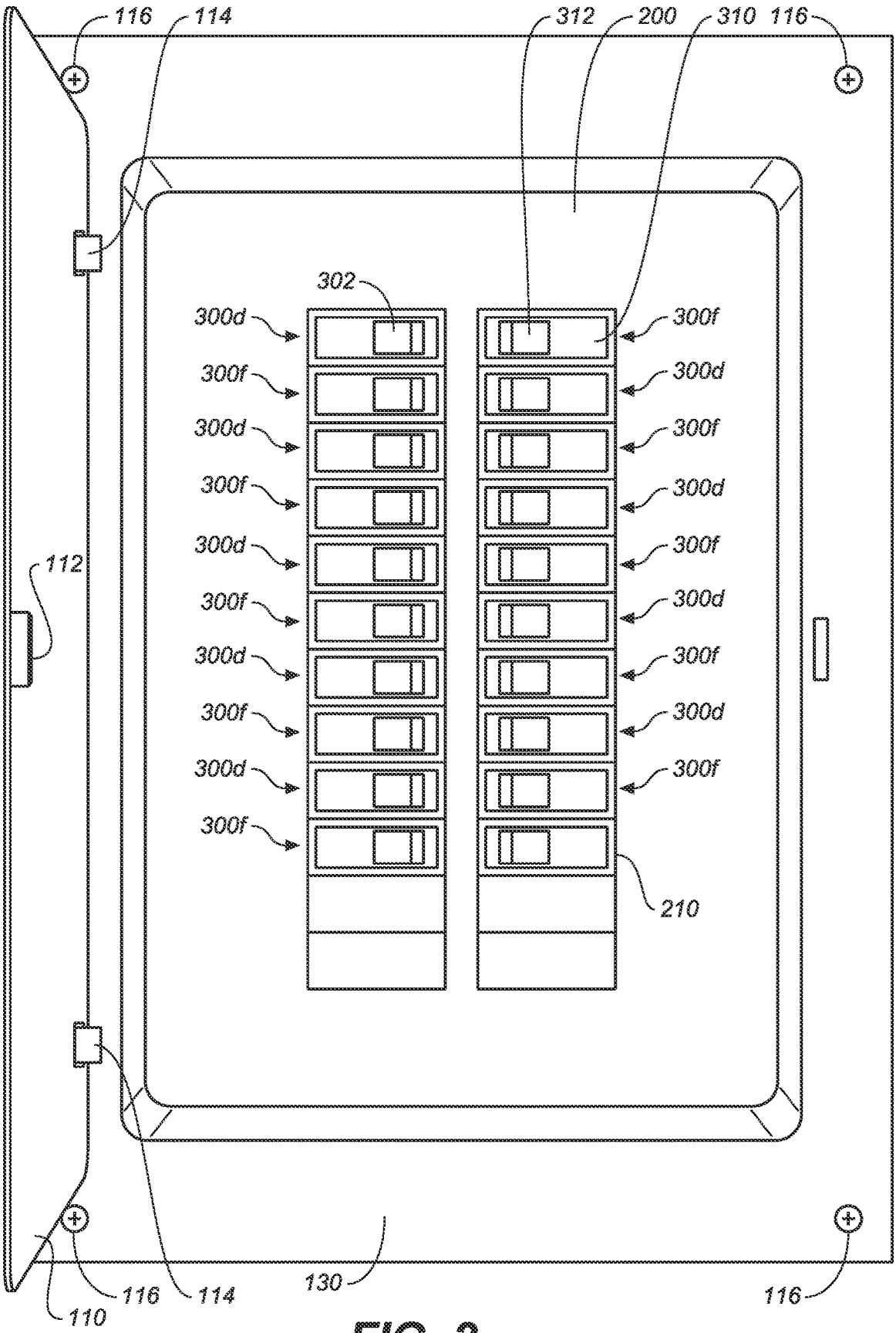
FIG. 2 shows the wall safe with its door opened to reveal a removable cover disguised as the front cover of a circuit breaker panel.

In FIG. 2, the door 110 is shown opened to reveal a recessed bay, resembling the circuit breaker bay of a circuit breaker panel, and a recessed access panel 200. In the illustrated embodiment a total of twenty imitation circuit breaker switches 300*f* and 300*d* are shown mounted in openings 210 in access panel 200. With additional reference to FIGS. 5A-5C, it is seen that functional switch locks 300*f* include a pivotable toggle arm 302 having a front portion 304 disposed in front of the access panel 200 and a back portion 306 disposed behind. Diversion switches 300*d* include only pivotable arm 312 consisting mostly of a front portion 314 disposed in front of the access panel 200 but having no functional back portion. The front portions 304 of the toggle arms 302 of functional switch locks 300*f* and the front portions 314 of the pivotable arms 312 of diversion switches 300*d*, together with the recessed access panel 200, closely resemble a circuit breaker panel. Switch locks 300*f*, however, include functional sliding bolts 350 hidden behind the access panel that can be used to lock the access panel 200 in place. The diversion switches 300*d* appear identical to the functional switch locks 300*f* from the front but do not have sliding bolts 350 and do not perform a locking function. Yet, all the switch locks 300*f* and diversion switches 300*d* can be manually flipped between what appear to be "on" and "off" positions to imitate circuit breaker switches in a circuit breaker panel. As explained in further detail below with reference to FIGS. 4A-4C the arrangement of both functioning switch locks 300*f* and diversion switches 300*d* provides a form of password protection for the wall safe 100.

Figure 3:
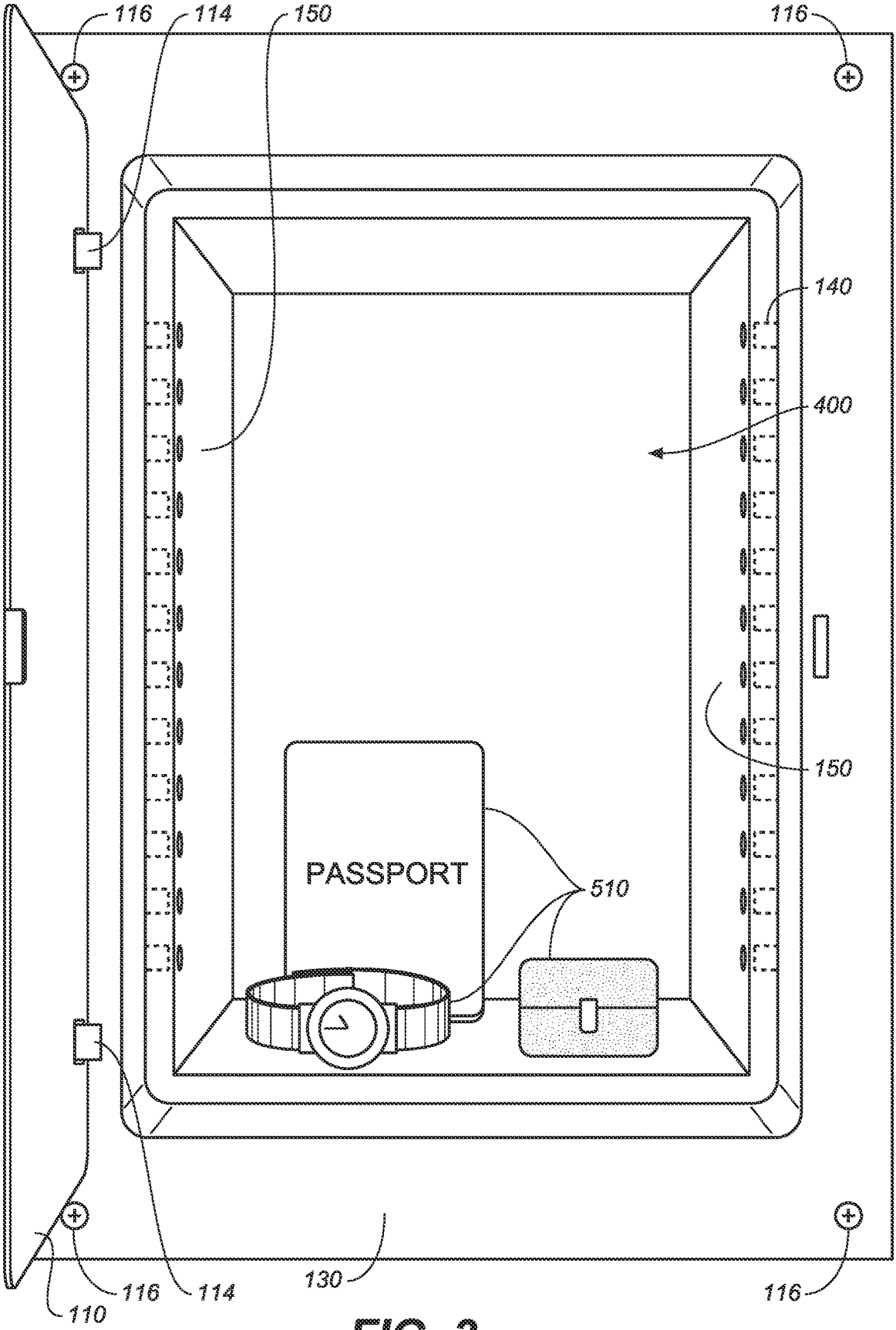
FIG. 3 shows the wall safe with the cover unlocked and removed to reveal a hidden storage enclosure.

In FIG. 3, the access panel 200 is shown having been removed to reveal a hidden storage enclosure 400 for storing valuables 510. A plurality of locking apertures 140 for receiving the sliding bolts 320 (see FIGS. 4A-4C) of the combination switch and sliding bolt locks 300*f* are located behind access panel 200 in the sidewalls 150 of the enclosure 400.

Figure 4A:
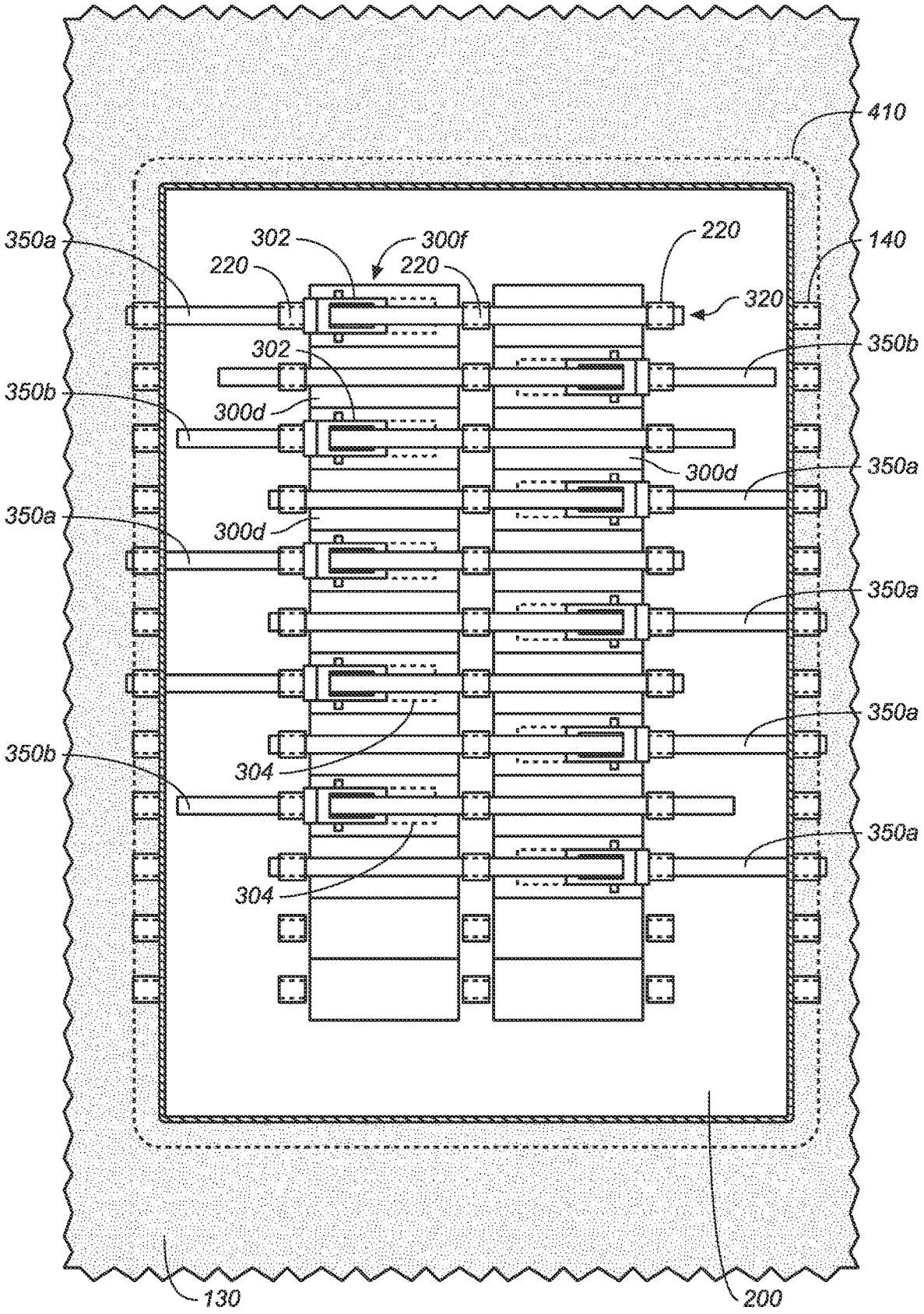
FIGS. 4A-4C show the rear face of the cover with several combination faux switch and sliding bolt locks mounted thereto.
Figure 4B:
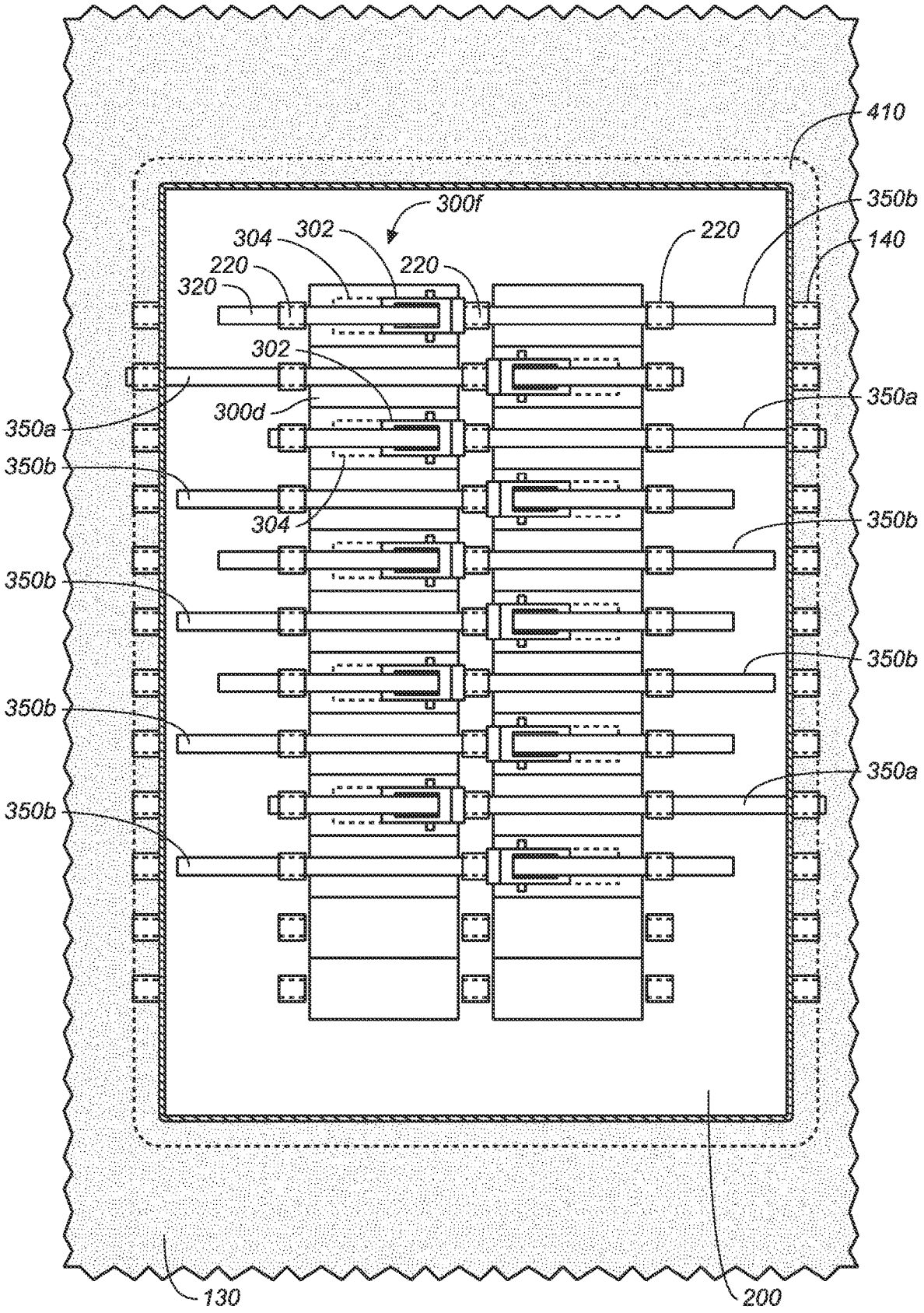

FIG. 4A shows the rear face of the access panel 200 with the switches 300*f* arranged in a locked configuration corresponding to the configuration of switches shown in FIG. 2. Thus, as seen in FIG. 2, all the front portions 304 of the combination switch and sliding bolt locks 300*f*, as well as those of the imitation switch locks 300*d*, are flipped towards the center of the access panel 200 which could appear to indicate that all breakers are on. As explained in more detail below, moving front portion 304 of toggle arm 302 in one direction moves the back portion 306 in the opposite direction which results in a sliding movement of the bolt 350. Retaining catches 220 are mounted to the back side of the access panel 200 to guide the sliding movement of the bolts 350.

With continued reference to FIG. 4A, flipping all the front portions 304 of the toggle arms 302 towards the center of the access panel 200 slides all the bolts 350 towards the outer edges thereof. In this configuration, some of the bolts 350A extend enough on the side opposite the position of the front portion 304 that a part thereof extends into one of the locking apertures 140 provided in the sidewalls 150 of the enclosure 400. These locks are in a locked configuration. The other bolts 350B do not extend far enough to be received into the adjacent locking aperture 140. These locks remain in an unlocked configuration. Additionally, the diversion switch locks 300*d* are not connected to any bolts but are indistinguishable from functional switch locks 300*f* that are connected to locking bolts.

By utilizing switch locks 300*f* having bolts 350 in this manner, and by doing so in no apparent pattern, the plurality of switch locks 300*f* can provide a form of password protection for the safe 100. For example, in a second locked configuration shown in FIG. 4B, all the front portions 304 of toggle arms 302 have been flipped towards the outer edges of the access panel 200 such that the back portions 306 move to the center of the access panel 200 and slide the bolts. In this second configuration, again some of the bolts 350*a* are in a locked configuration, while others 350*b* are unlocked. In this manner, neither flipping all the faux switches towards the center of the access panel 200 nor flipping all the faux switches towards the outer edges of the cover will unlock all the locks 300*f*. Instead, the faux switches must be flipped in a particular combination in order to fully unlock the access panel 200 as shown in FIG. 4C.

Figure 4C:
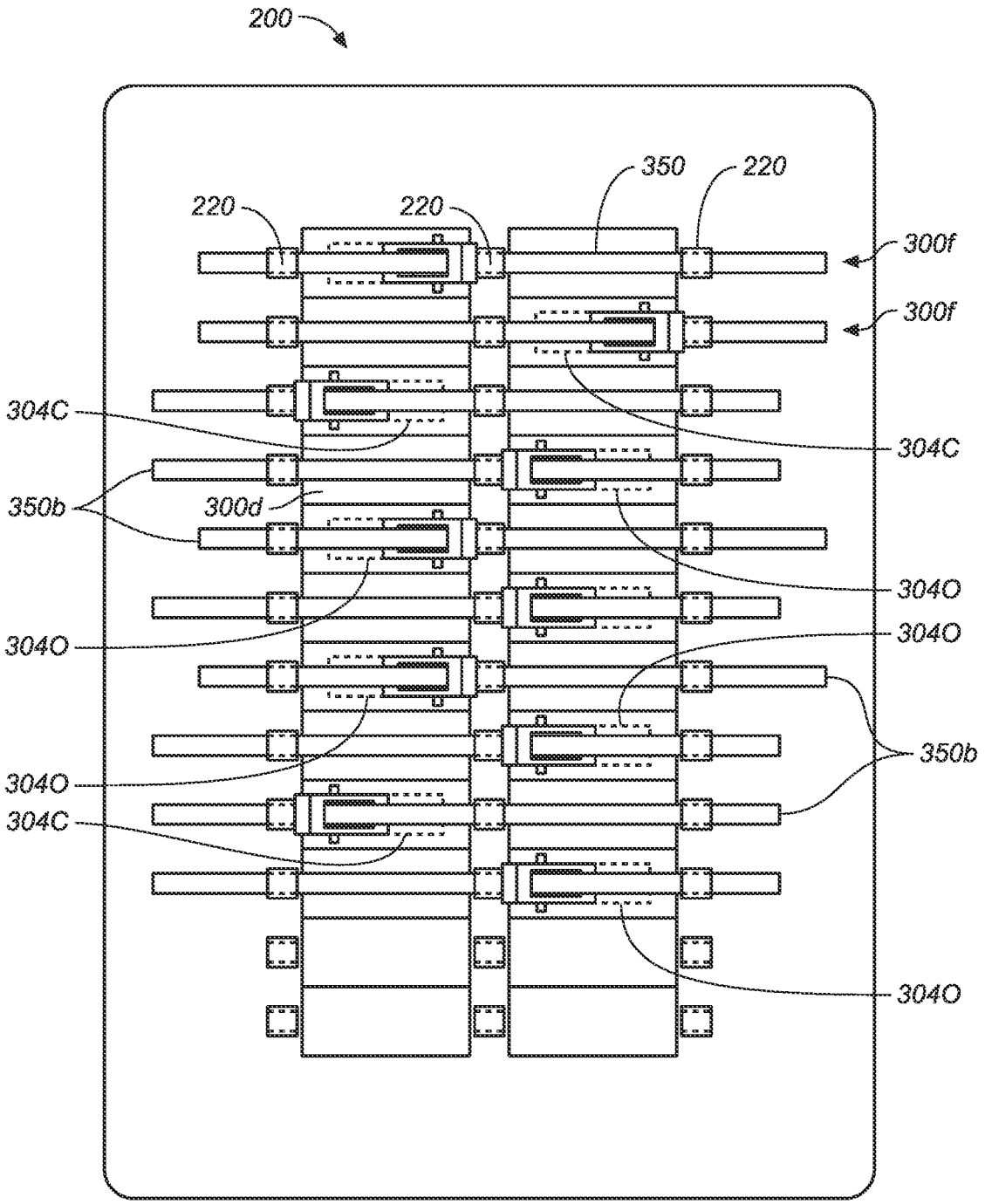

In FIG. 4C, the access panel 200 is shown removed from the safe 100 and in an unlocked configuration. Some of the front portions 304C of the toggle arms are flipped towards the center of the access panel 200, while others 304O are flipped towards the outer edges of the access panel 200 such that all the locks 300*f* are now in an unlocked position. A user must know this exact arrangement of the front portions 304C, 304O of the toggle arms 302 in order to unlock the safe 100. In some embodiments, the access panel 200 will be an integral portion of front cover 130 so that the entire front cover 130 would be removed when the switch locks are moved to an unlocked configuration.

Figure 5A:
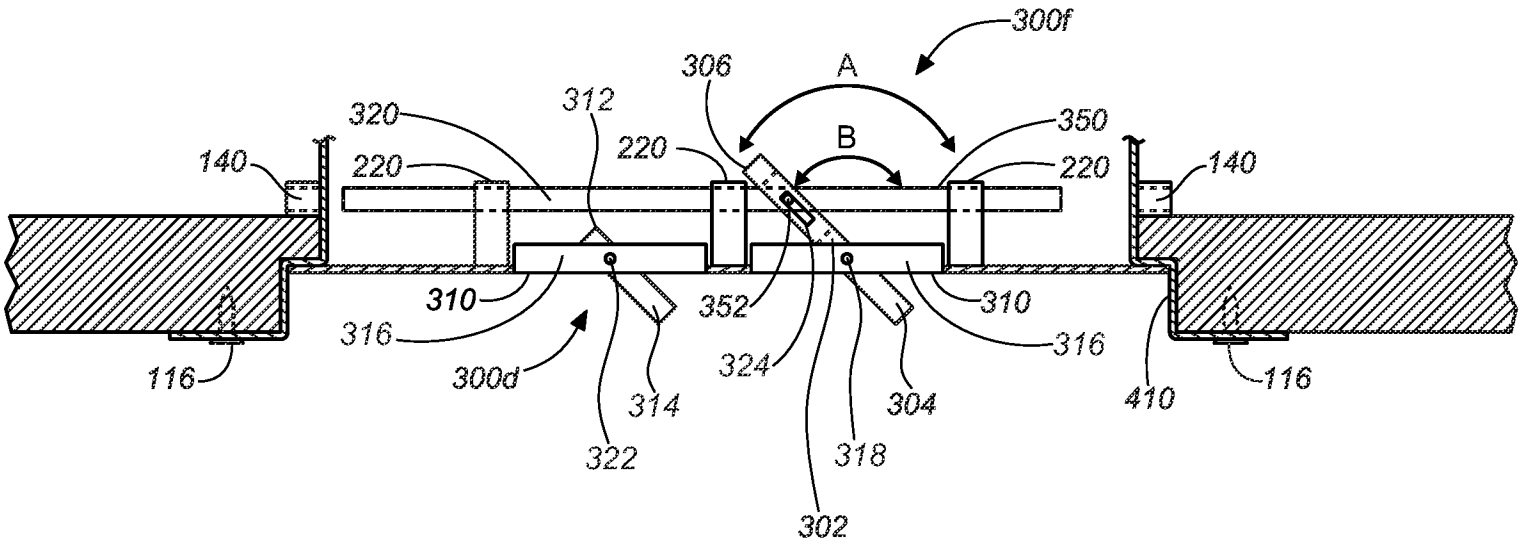
FIGS. 5A-5C are a series of top plan views of an exemplary combination faux switch and sliding bolt lock according to the invention showing the sliding movement of the bolt from an unlocked to a locked position.
Figure 5B:
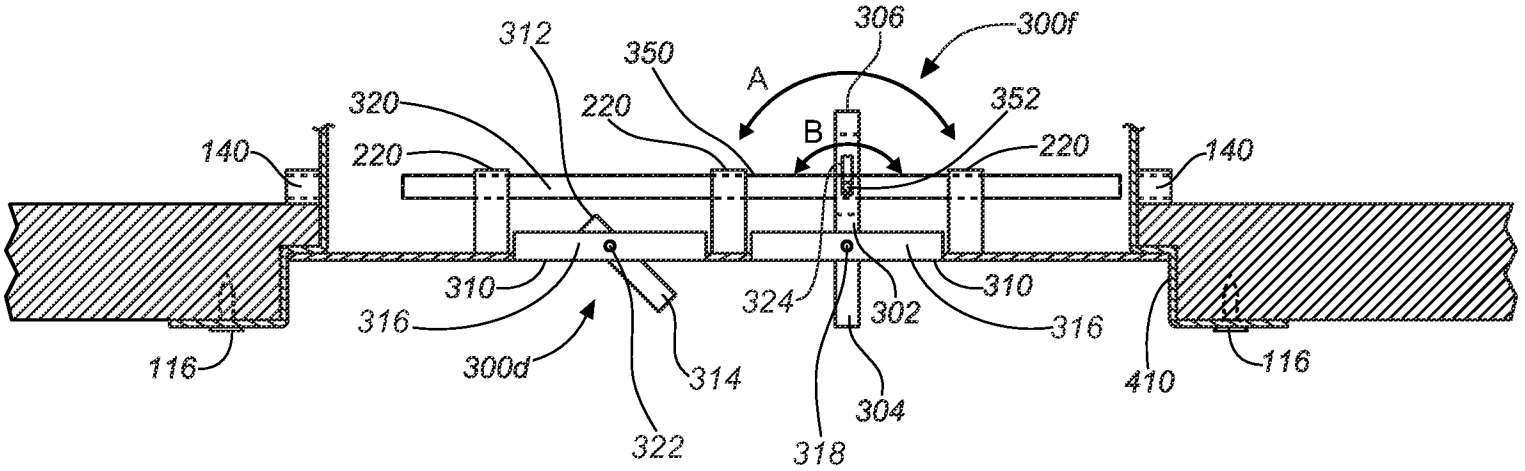
Figure 5C:
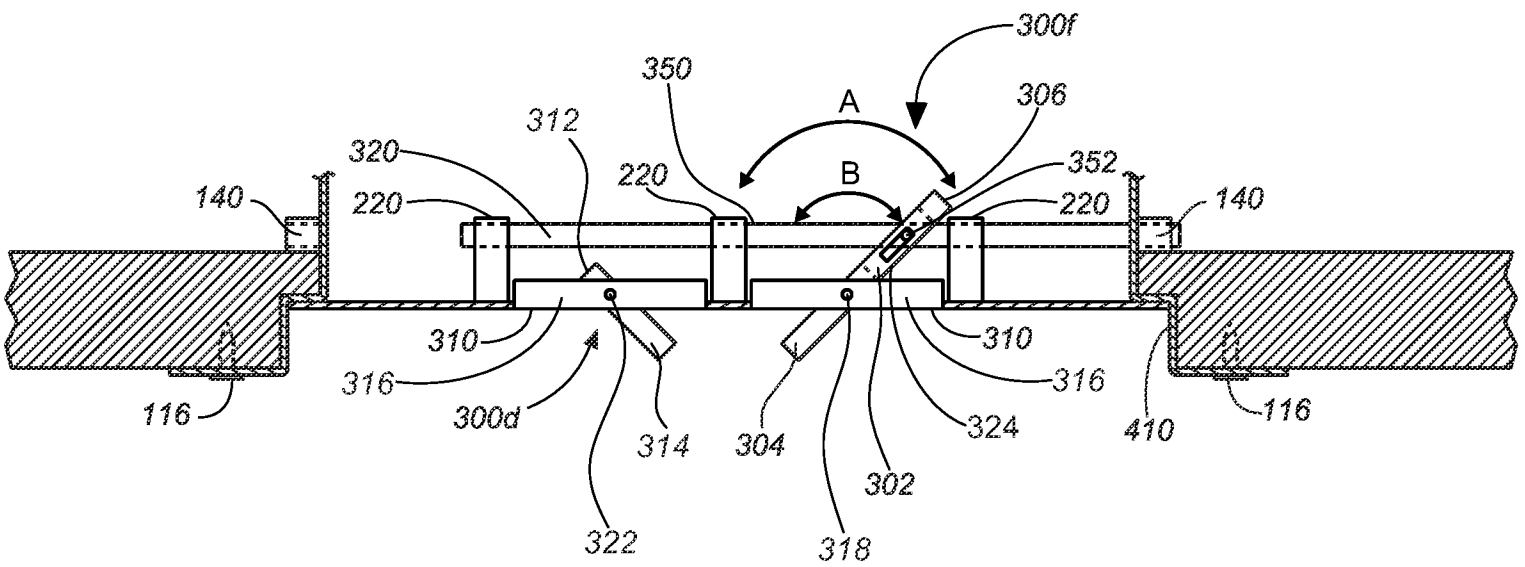

FIGS. 5A-5C show a switch lock 300*f* moving from an unlocked configuration seen in FIG. 5A to a locked configuration seen in FIG. 5C. Toggle arm 302 is pivotably connected to the switch housing 316 about a pivot axis 318 such that as between the unlocked and locked configurations it passes through an arc A. Similarly, arm 312 of diversion switch lock 300*d* is pivotably connected with switch housing 316 about a pivot axis 322 so that movement of the front portion 314 thereof is the same as that of the front portion 304 of arm 302. The toggle arm 302 and bolt 350 of switch lock 300*f* are connected by a pin 352 on the bolt 350 that is disposed in a slot 324 provided in the back portion 306 thereof of bolt 350. Movement of toggle arm 302 through arc A causes slot 324 to move through smaller concentric arc B driving pin 352 and hence bolt 350 between the unlocked position shown in FIG. 5A, a midway position shown in FIG. 5B, and the locked position shown in FIG. 5C, during which pin 324 travels longitudinally in slot 324. Switch plates 310 (see again FIG. 2) mask the portions of the toggle arm from view. In FIG. 5A, the front portion 304 of toggle arm 302 is positioned to the right and no portion of the bolt 350 is disposed in either locking aperture 140. As the front portion 304 is moved to the left, the bolt 350 slides towards and a portion thereof is received within the right-side locking aperture 140 as seen in FIG. 5C. In contrast, the diversion switch lock 300*d* is not connected to a bolt so that movement of the front portion 314 thereof does not affect an of the locking bolts in the wall safe.

Figure 6A:
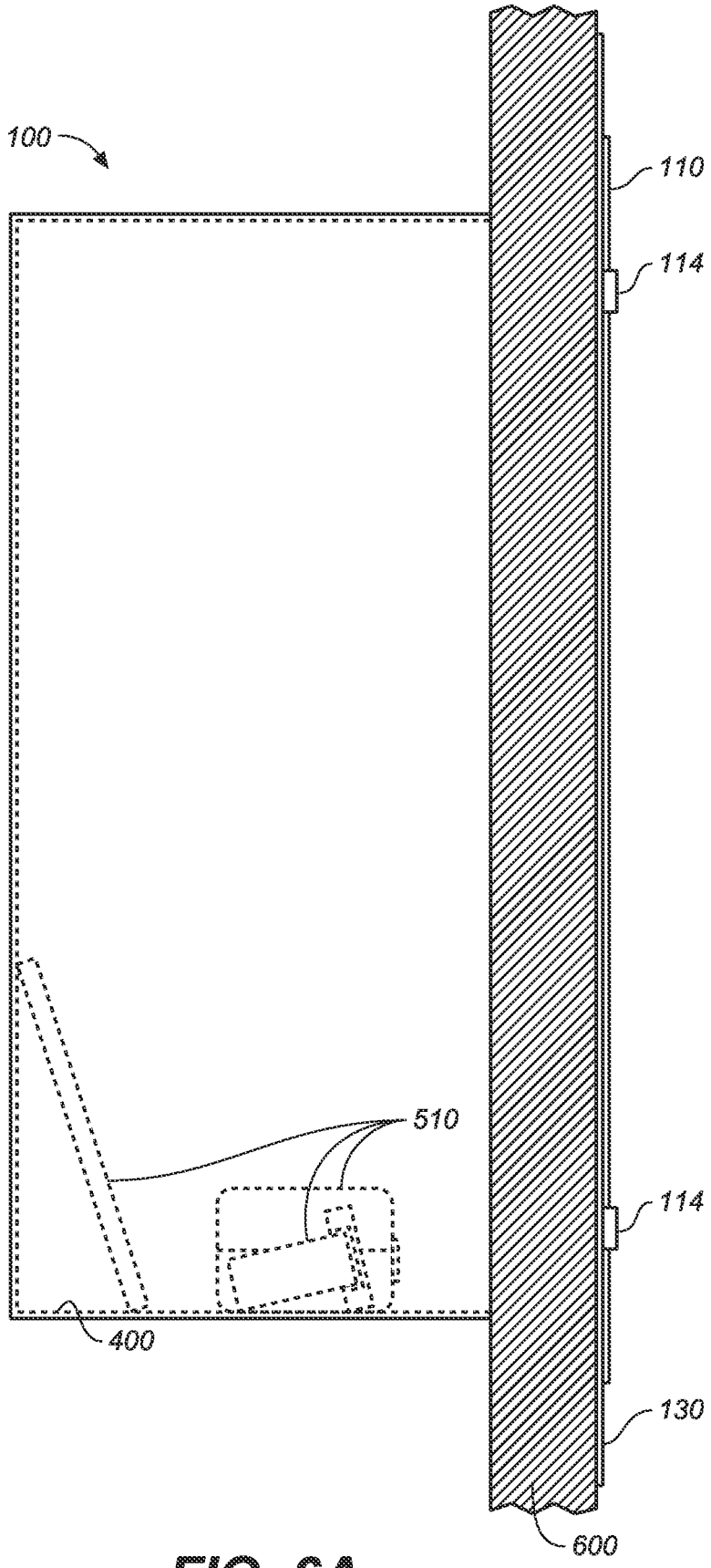
FIGS. 6A and 6B show two different mounting configurations of a wall safe disguised as a circuit breaker panel according to the invention.
Figure 6B:
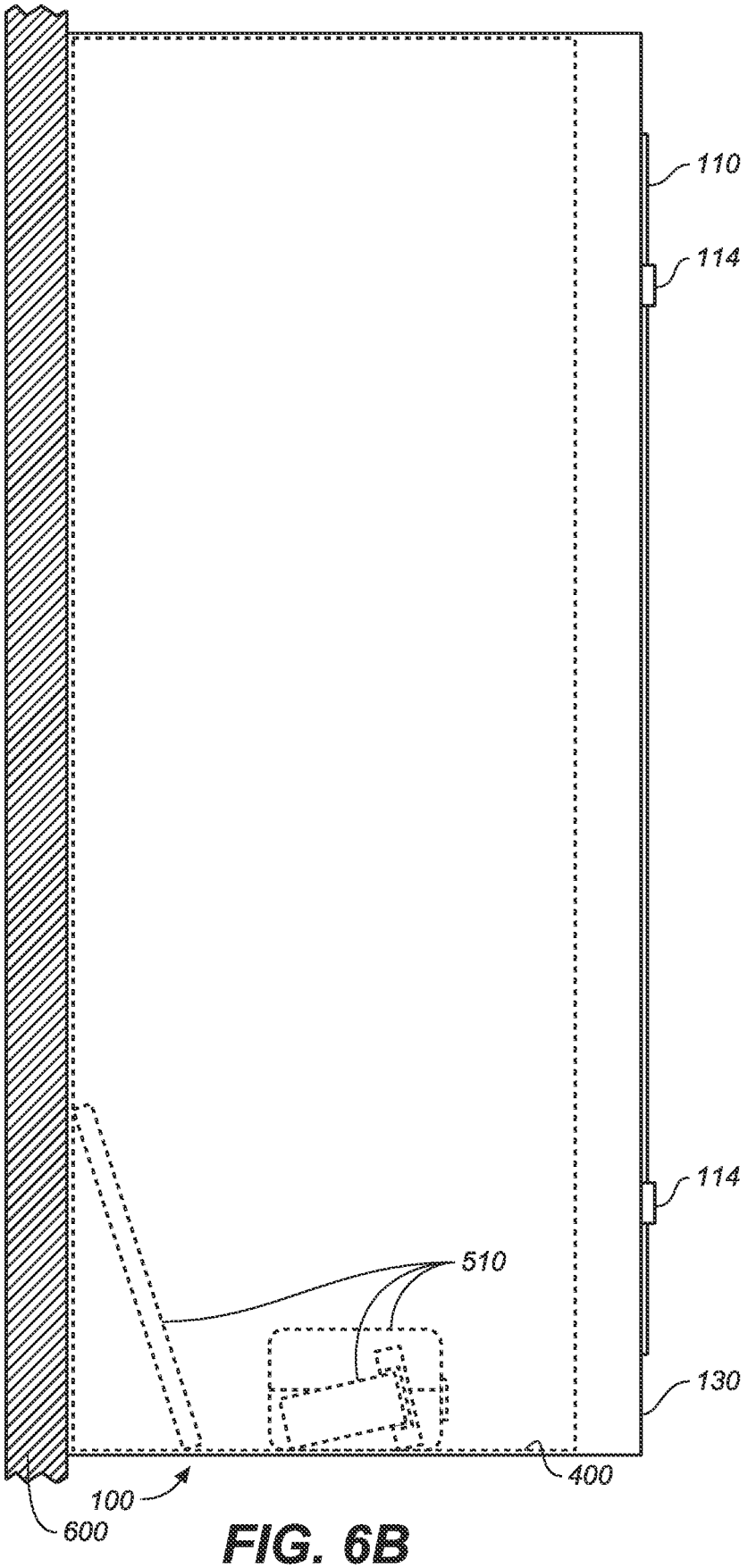

The wall safe 100 can be mounted in the stud bay of wall 600, as shown in FIG. 6A, or can be surface mounted to a wall 600, as shown in FIG. 6B. In the surface mounted configuration FIG. 6B, the hidden storage enclosure 400 could extend into a stud bay or other area behind the wall 600 allowing for more storage space.

Although the combination switch and sliding bolt lock of the invention is useful as a wall safe, such as the illustrated faux circuit breaker panel having one or more switches, it can be incorporated into many other types of safes, chests, cabinets and storage receptacles.

Certain embodiments of a combination switch and sliding bolt lock, and a wall safe incorporating the same, have thus been described and illustrated herein in detail. These embodiments are merely example implementations of the invention and are not intended to limit the scope of the invention to their particular details. Alternative embodiments of the invention not expressly disclosed herein will be evident to persons of ordinary skill in the art.

I claim:

1. A combination faux switch and sliding bolt lock wall safe comprising:

an enclosure having opposing side walls and a front cover, each of the side walls having a plurality of bolt-receiving apertures, the front cover having front and rear faces, a plurality of switch locks each having a toggle arm pivotally attached to the front cover, the toggle arm having a front portion projecting from the front face of the front cover and a back portion disposed in the enclosure behind the front cover, the toggle arm moveable between first and second positions by manipulating said front portion, the front portion resembling a circuit breaker in a circuit breaker panel, and a plurality of bolts each having two opposite ends, the plurality of bolts disposed in the enclosure behind the front cover, each of the plurality of bolts slidably attached to the rear face of the cover and engaged with the back portion of one of the toggle arms, movement of said toggle arm between the first and second positions causing the bolt to slide between locked and unlocked positions, wherein when one of the plurality of bolts is in said locked position one of the ends of said bolt is received in one of the plurality of apertures in one of the side walls of the enclosure, thereby preventing the front cover from being separated from said side wall in a direction perpendicular to said one of said plurality of bolts.

2. The combination faux switch and sliding bolt lock wall safe of claim 1 further comprising:

when said plurality of bolts are in the locked position one of the ends of at least one of the plurality of bolts is received in one of the apertures of each of the side walls, thereby preventing the front cover from being removed from the side walls of the enclosure.

3. The combination faux switch and sliding bolt lock wall safe of claim 2 further comprising:

said at least one of the plurality of bolts being at least two, and when said bolts are in the locked position one of the ends of each of the at least two bolts being received in one of the apertures of each of the side walls.

4. The combination faux switch and sliding bolt lock wall safe of claim 1 further comprising:

the front cover having the appearance of an electric circuit panel.

5. The combination faux switch and sliding bolt lock wall safe of claim 1 further comprising:

one or more of the plurality of faux electrical switches not being engaged with any of the plurality of bolts thereby creating one or more imitation switch locks.

6. The combination faux switch and sliding bolt lock wall safe of claim 1 further comprising:

one or more of the bolts having two opposite ends, said one or more bolts disposed in the enclosure behind the front cover and slidably attached to the rear face of the cover and engaged with the back portion of one of the toggle arms, movement of said toggle arm between the first and second positions causing the bolt to slide between left and right positions in both of which neither end of said one or more bolts is received in any of the apertures of either of the side walls of the enclosure, thereby creating one or more imitation switch locks.

7. The combination faux switch and sliding bolt lock wall safe of claim 1 further comprising:

the back portion of each of the plurality of toggle arms having a slot, during movement of the toggle arms between first and second positions the back portion thereof travels through an arc, and each of the plurality of bolts having a pin extending radially from the longitudinal axis of the bolt which is captured in the slot of one of the plurality of toggle arms, such that during movement through said arc of the back portion of one of the toggle arms between the first and second positions the pin travels longitudinally in the slot and motivates the bolt to move between said locking and unlocking positions.

8. The combination faux switch and sliding bolt lock wall safe of claim 1 further comprising:

the front cover of the enclosure having a recess, said plurality of faux electrical switches mounted in the recess, a door attached to the front cover for covering the recess and concealing the faux electrical switches.

9. The combination faux switch and sliding bolt lock wall safe of claim 1 further comprising:

the front cover of the enclosure resembling an electrical panel.

10. A combination faux switch and sliding bolt lock wall safe comprising:

an enclosure having opposing side walls and a front cover, each of the side wads having a plurality of bolt-receiving apertures, the front cover having front and rear faces, a plurality of faux electrical switches each having a toggle arm pivotally attached to the front cover, the toggle arm having a front portion projecting from the front face of the front cover and a back portion disposed in the enclosure behind the front cover, the toggle arm moveable between first and second positions by manipulating said front portion, and a plurality of bolts each having two opposite ends, the plurality of bolts disposed in the enclosure behind the front cover, each of the plurality of bolts slidably attached to the rear face of the front cover and engaged with the back portion of one of the toggle arms, movement of said toggle arm between the first and second positions causing said engaged bolt to slide between locked and unlocked positions, wherein when each of the plurality of bolts is in said locked position one of the ends of one or more of the plurality of bolts is received in one of the plurality of apertures in each of the side walls of the enclosure, thereby preventing the front cover from being separated from said side walls.

11. A combination faux switch and sliding bolt lock wall safe comprising:

an enclosure having opposing side walls and a front cover, each of the side wads having a plurality of bolt-receiving apertures, the front cover resembling an electrical circuit panel and having front and rear faces, a plurality of faux electrical switches each having a toggle arm pivotally attached to the front cover, the toggle arm having a front portion projecting from the front face of the front cover and a back portion disposed in the enclosure behind the front cover, the back portion having a slot, the toggle arm moveable between first and second positions by manipulating said front portion, during movement of the toggle arm between first and second positions the back portion thereof traveling through an arc, and a plurality of bolts each having two opposite ends, the plurality of bolts disposed in the enclosure behind the front cover, each of the plurality of bolts slidably attached to the rear face of the cover and engaged with the back portion of one of the toggle arms, each of the plurality of bolts having a pin extending radially from the longitudinal axis thereof and said pin is captured in the slot of the back portion of one of the plurality of toggle arms, such that during movement of the back portion of the toggle arm through said arc between the first and second positions the pin travels longitudinally in the slot and motivates the bolt to move between said locking and unlocking positions, wherein when each of the plurality of bolts is in said locked position one of the ends of one or more of the plurality of bolts is received in one of the apertures in each of the side walls of the enclosure, thereby preventing the front cover from being separated from said side walls.

12. The combination faux switch and sliding bolt lock wall safe of claim 11 further comprising:

one or more of the bolts having two opposite ends, said one or more bolts disposed in the enclosure behind the front cover and slidably attached to the rear face of the cover and engaged with the back portion of one of the toggle arms, movement of said toggle arm between the first and second positions causing the bolt to slide between left and right positions in both of which neither end of said one or more bolts is received in any of the apertures of either of the side walls of the enclosure, thereby creating one or more imitation switch locks.

* * * * *